US008020856B2

(12) United States Patent
Morohashi

(10) Patent No.: US 8,020,856 B2
(45) Date of Patent: Sep. 20, 2011

(54) IMAGE FORMING APPARATUS

(75) Inventor: Takeo Morohashi, Yokohama (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 199 days.

(21) Appl. No.: 12/408,005

(22) Filed: Mar. 20, 2009

(65) Prior Publication Data

US 2009/0283966 A1 Nov. 19, 2009

(30) Foreign Application Priority Data

May 15, 2008 (JP) ..... 2008-127787

(51) Int. Cl.
*B65H 29/00* (2006.01)

(52) U.S. Cl. ..... 271/184; 271/185; 399/15

(58) Field of Classification Search ..... 271/184, 271/185; 399/10, 15, 20
See application file for complete search history.

(56) References Cited

U.S. PATENT DOCUMENTS

| | | | | |
|---|---|---|---|---|
| 3,936,180 | A * | 2/1976 | Willard et al. | 399/10 |
| 7,075,667 | B1 * | 7/2006 | Bonikowski et al. | 358/1.14 |
| 7,747,178 | B2 * | 6/2010 | Tsukamoto | 399/15 |
| 2008/0260413 | A1 * | 10/2008 | Kimura | 399/82 |

FOREIGN PATENT DOCUMENTS

| | | |
|---|---|---|
| JP | 02-235785 | 9/1990 |
| JP | 08-197779 | 8/1996 |
| JP | 2005-153374 A | 6/2005 |
| JP | 2005-157015 A | 6/2005 |
| JP | 2005-289567 | 10/2005 |
| JP | 2007-055086 | 3/2007 |
| JP | 2007-076130 | 3/2007 |

OTHER PUBLICATIONS

Notice of Reasons for Refusal issued in the corresponding Japanese Patent Application No. 2008-127787 dated Apr. 13, 2010, and an English Translation thereof.

* cited by examiner

*Primary Examiner* — Kaitlin S Joerger
(74) *Attorney, Agent, or Firm* — Buchanan Ingersoll & Rooney PC

(57) ABSTRACT

An image forming apparatus includes: an image forming section which forms normal images on sheets sequentially based on normal image data and forms sample images on sheets based on sample image data; a discharge section which discharges normal image sheets in a stack which are sheets on which the normal images were formed and sample image sheets which are sheets on which the sample images were formed; and a control section which is configured to control at least one of the image forming section and the discharge section to discharge the normal image sheets in the stack and the sample image sheets to the discharge section so as to enable timings at which the sample image sheets were discharged to be appreciated in the stacked normal image sheets.

6 Claims, 7 Drawing Sheets

IMAGE FORMING APPARATUS

RELATED APPLICATION

The present application is based on Japanese Patent Application No. 2008-127787 filed with Japanese Patent Office on May 15, 2008, the entire content of which is hereby incorporated by reference.

BACKGROUND OF THE INVENTION

1. Field of the Invention

The present invention relates to image forming apparatuses that discharge sheets for normal images and sheets for sample images.

2. Description of the Related Art

Conventionally, image forming apparatuses have been known to form images on sheets based on image data, and discharge the sheets on which images have been formed. The image forming apparatuses are, for example, copying machines or printers, etc. When the image forming apparatus is a copying machine, the image forming apparatus obtains the image data by reading out the image from an original document. On the other hand, when the image forming apparatus is a printer, the image forming apparatus obtains the image data from an external apparatus such as a personal computer, etc. In the following explanations, an image that is formed based on image data that is the object to be copied or printed out is called a normal image.

Here, there is a case in which the image forming apparatus successively discharges sheets on which normal images have been formed. For example, this is the case of carrying out image formation based on the image data of a plurality of pages, or of carrying out image formation of a plurality of copies based on the image data of a single page, etc. In such a case, if a situation occurs in which some abnormality occurs in the image quality of the images formed on the sheets, a large number of defective outputs may be generated, and therefore it is necessary to verify whether or not there is any abnormality in the image quality in the middle of carrying out successive image formations.

For example, image forming apparatuses have been known to discharge a sample image sheet which is a sheet on which a sample image has been formed (see, for example, Japanese Unexamined Patent Application Publication No. 2005-153374 and Japanese Unexamined Patent Application Publication No. 2005-157015). In such an image forming apparatus, the destination of discharging normal image sheets on which normal images have been formed and the destination of discharging sample image sheets are distinguished from each other.

However, in the image forming apparatus described above, even if it is possible to confirm that there is an abnormality in the image quality of the sample image formed on the sample image sheet that has been discharged, it is difficult to grasp at what time that the sample image sheet was discharged. In other words, it is difficult to grasp at what time the abnormality occurred in the normal image formed on the normal image sheet. In particular, in cases in which a large number of the normal image sheets are output from the image forming apparatus, it is still more difficult to grasp at what time the sample image sheet was discharged, and it is extremely difficult to grasp at what time the abnormality occurred in the normal image formed on the normal image sheet.

Further, although the user may constantly monitor the time at which the sample image sheet was discharged, in this case the load on the user is extremely high.

SUMMARY

The present invention has one perspective addressing the above problem, and the major purpose of the present invention according to the perspective is to provide a novel image forming apparatus which makes it possible to easily appreciate the timing at which an abnormality occurred in the normal images formed on the normal image sheets.

To achieve at least one of the above mentioned purpose and other object, an image forming apparatus reflecting one aspect of the present invention comprises: an image forming section which forms normal images on sheets sequentially based on normal image data and forms a sample image on a sheet based on sample image data; a discharge section which discharges normal image sheets in a stack which were sheets on which the normal images were formed and a sample image sheet which is a sheet on which the sample image was formed is discharged; and a control section which is configured to control at least one of the image forming section and the discharge section to discharge the normal image sheets in the stack and the sample image sheet to the discharge section so as to enable a timing at which the sample image sheet was discharged to be distinguished in the normal image sheets in the stack.

BRIEF DESCRIPTION OF THE DRAWINGS

These and other objects, advantages and features of the invention will become apparent from the following description thereof taken in conjunction with the accompanying drawings in which.

DETAILED DESCRIPTION OF THE PREFERRED EMBODIMENTS

Figure 1:
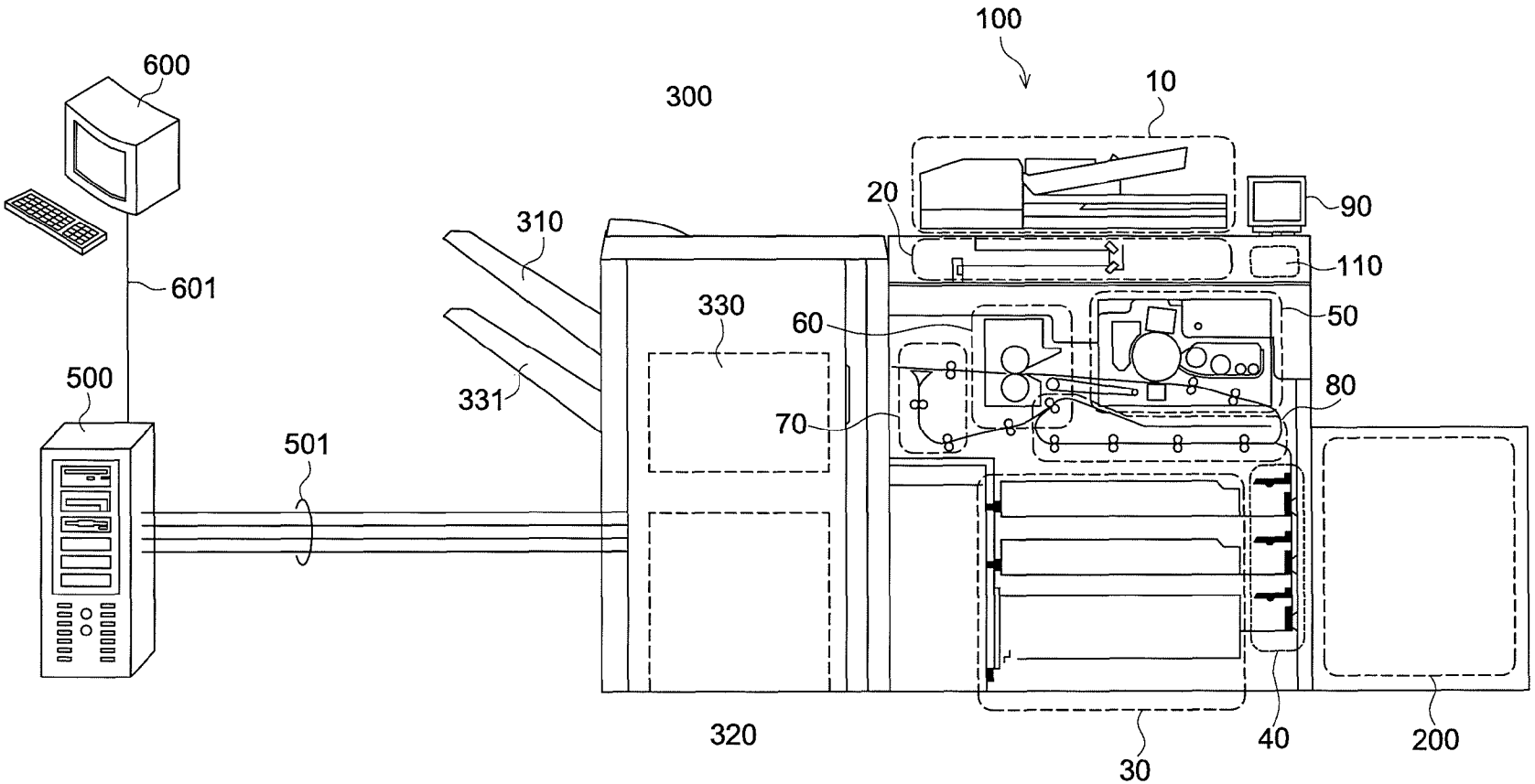
FIG. 1 is a diagram showing the schema of an image forming apparatus 100 according to a first preferred embodiment.

In the following, explanations are given regarding image forming apparatuses according to some preferred embodiments of the present invention with reference to the drawings. Further, in the drawings shown below, identical or similar parts have been assigned the same or similar symbols.

However, the drawings are merely schematic drawings, and it is necessary to note that the ratios of the different dimensions are different from real ones. Therefore, the concrete dimensions, etc., should be judged while making allowances for the following explanations. In addition, even between different drawings, it goes without saying that parts are included that have different dimensional relationships or ratios.

First Preferred Embodiment (Schema of an Image Forming Apparatus)

In the following, the schema of an image forming apparatus according to a first preferred embodiment of the present invention is explained while referring to the drawings. FIG. 1 is a diagram showing the schema of an image forming apparatus 100 according to the first preferred embodiment. However, it should be noted that a detailed configuration of the image forming apparatus 100 has been omitted in FIG. 1.

As is shown in FIG. 1, the image forming apparatus 100 has an automatic document feeding unit 10, an image read out unit 20, a sheet tray unit 30, a sheet feeding unit 40, an image forming unit 50, a fixing unit 60, a sheet discharge unit 70, a reversing unit 80, and an operation unit 90. The image forming apparatus 100 further has a sheet feeding apparatus 200 and a finishing apparatus 300.

The image forming apparatus 100 is connected to a user terminal 600 via a print controller 500. The image forming apparatus 100, for example, is connected to the print controller 500 via a video bus 501. The print controller 500, for example, is connected with the user terminal 600 via a LAN (Local Area Network) 601.

In the first preferred embodiment, an example of an MFP (Multiple Function Peripheral) that forms images on sheets using the electro-photographic method is shown as the image forming apparatus 100. However, the method of forming images is not restricted to the electro-photographic method, but can also be an ink jet method, a thermal transfer method, a dot impact method, etc.

In the first preferred embodiment, the image forming apparatus 100 has the functions of discharging the normal image sheets that are the sheets on which normal images have been formed and of discharging sample image sheets which are sheets on which sample images have been formed. The image forming apparatus 100, as is explained later, discharges the sample image sheets when sample sheet discharge conditions have been satisfied.

The automatic document feeding unit 10 is a unit that conveys the original document which has to be copied. In concrete terms, the automatic feeding unit 10 has a document loading tray, a document separating section, a document conveying section, a document discharge section, a document discharge tray, and a document reversing section.

The document loading tray is a tray for placing the original document therein. In case where a plural sheet of documents are placed on the document loading tray, the document separating section separates the documents and feeds one sheet of the documents at a time. The document conveying section has a set of rollers that convey the document that has been separated by the document separating section up to the image reading position. The document discharge section discharges the document that has been conveyed by the document conveying section to the document discharge tray. The document discharge tray is the tray on which the documents that have been discharged by the document discharge section are placed. The document reversing section turns the document upside down in the double sided copying mode.

The image read out unit 20 is a unit that reads out the images of the documents, and generates the image data. In more specific terms, the image read out unit 20 has a platen glass, a lamp, a mirror unit, an imaging lens, and an image sensor.

The platen glass is a table on which the document is placed in the case in which the copying of the document is made without using the automatic document feeding unit 10.

The lamp emits light that illuminates the original document. The lamp emits light on the document via a slit in the case in which the automatic document feeding unit 10 is used. On the other hand, in the case in which the automatic document feeding unit 10 is not used, the lamp emits light on to the document by carrying out a scanning movement along the underside surface of the platen glass. The mirror unit reflects the light reflected from the document, and guides the light reflected from the document on to the imaging lens. The imaging lens forms an image from the light reflected by the mirror unit. In specific terms, the imaging lens forms an image on the image sensor from the light reflected by the mirror unit. The image sensor is an optoelectronic conversion device such as a CCD image sensor that reads out the light of the image formed by the imaging lens. The image signals obtained from the CCD image sensor is subjected to A/D conversion, shading correction, etc., and is converted into image data in the form of digital data.

The sheet tray unit 30 is a unit that stores the sheets. The sheet tray unit 30 has a plurality of sheet feeding trays, a plurality of sheet feeding rollers, a plurality of separating rollers, and a plurality of photo sensors.

Each sheet feeding tray is a tray that stores a plurality of sheets. Each sheet feeding roller sends out the sheet stored in the sheet feeding tray towards the separating rollers. The separating rollers separates the sheets sent out from the sheet feeding rollers one sheet at a time. Each photo sensor detects whether or not the sheet has arrived at the set of rollers described later.

The sheet feeding unit 40 is a unit that feeds sheets to the image forming unit 50. The sheet feeding unit 40 has plural sets of rollers, conveying rollers, registration rollers, and pre-copying rollers.

The plural sets of rollers convey the sheet set out from the sheet tray unit 30 or the sheet feeding apparatus 200. The conveying rollers convey the sheet conveyed by the plural sets of rollers towards the registration rollers. Further, the conveying rollers convey the sheet conveyed from the sheet discharge unit 70 to be described later towards the registration rollers. The registration rollers are the rollers for aligning the leading edge of the sheet conveyed from the conveying rollers, and convey the sheet that has been aligned towards the pre-copying rollers. Further, at the time at which the sheet has arrived at the registration rollers, the formation of the toner image is started by the image forming unit 50. The pre-copying rollers convey the sheet conveyed from the registration rollers towards the image forming unit 50.

The image forming unit 50 is a unit that forms a toner image on the sheet supplied by the sheet feeding unit 40 based on the image data generated by the image read out unit 20. The image forming unit 50 has a photoreceptor drum, a charging unit, a write processing section, a developing unit, a transferring unit, a separating section, a cleaning section, and a conveying belt.

The photoreceptor drum is a drum on the surface of which is formed a photo conductive photosensitive layer, and is provided in a rotatable manner. The electrostatic latent image is formed on the surface of the photoreceptor drum, as is explained later. The charging unit uniformly charges the surface of the rotating photoreceptor drum.

The write processing section, in accordance with the image data obtained from the control unit 400, forms an electrostatic latent image on the surface of the photoreceptor drum. In concrete terms, the write processing section has a laser diode that emits laser light based on the image data, and a scanning optical unit that deflects and scans the laser light beam. The emitted laser light is deflected and scanned by the polygon mirror unit of the scanning optical unit in a direction (main scanning direction) at the right angle to the direction of rotation of the photoreceptor drum (the sub-scanning direction) and is imaged on to the photoreceptor drum thereby exposing the surface of the photoreceptor drum.

The developing unit forms a toner image on the surface of the photoreceptor drum by reverse developing the electrostatic latent image. The transfer unit has a transfer electrode for creating a potential difference with the photoreceptor drum. Using this potential difference, the toner image formed on the photoreceptor drum is transferred on to the sheet supplied by the sheet feeding unit 40.

The separating section separates the sheet on which the toner image has been formed from the photoreceptor drum. In specific terms, the separating section has a separating electrode that carries out corona discharge, and the separation of the sheet is promoted by the corona discharge. The cleaning section cleans the surface of the photoreceptor drum. In concrete terms, the cleaning section removes the toner remaining on the surface of the photoreceptor drum. The conveying belt conveys the sheet separated by the separating section towards the fixing unit 60.

The fixing unit 60 is a unit that affixes to the sheet the toner image formed on the surface of the sheet by applying heat and pressure. The fixing unit 60 has a heating roller, a pressure roller, and a cleaning web.

The heating roller heats the sheet on which the toner image has been formed. The pressure roller grips and conveys the sheet between the heating roller and the pressure roller. Because of this, the pressure roller presses the sheet on which the toner image has been formed. The cleaning web removes any toner that has become adhered to the pressure roller.

The sheet discharge unit 70 is a unit that discharges the sheet to which the toner image has been fixed. Further, the sheet discharge unit 70 turns the sheet upside down in the double sided copying mode. The sheet discharge unit 70 has a fixing discharge roller, switching section, sheet discharge rollers, and conveying rollers.

The fixing discharge roller conveys the sheet conveyed from the fixing unit 60 towards the switching section. The switching section determines whether or not the sheet conveyed from the fixing discharge roller is to be discharged. In concrete terms, the switching section, switches the conveying route of the sheet towards the sheet discharge roller in the single sided copying mode. The switching section, in the double sided copying mode, switches the conveying route of the sheet towards the sheet discharge roller if toner images have been formed on both sides of the sheet. On the other hand, if the toner image formation has not been completed on one side of the sheet in the double sided copying mode, the switching section switches the conveying route of the sheet towards the reversing unit 80.

The sheet discharge rollers discharge the sheet on which the fixing of the toner images has been completed towards the finishing apparatus 300. The conveying rollers, in the double sided copying mode, conveys the sheet on one side of which image formation has not been completed towards the reversing unit 80.

The reversing unit 80 is a unit that turns a sheet on one side of which image formation has not been completed upside down. The reversing unit 80 conveys the sheet conveyed from the sheet discharge unit 70 towards the image forming unit 50. In other words, the reversing unit 80 feeds the sheet to the image forming unit 50 again.

The operation unit 90 is a user interface for carrying out operations of the image forming apparatus 100. The operation unit 90 is configured using a touch screen which is a touch panel superimposed on a liquid crystal display panel, buttons, and switches.

The sheet feeding apparatus 200 is an apparatus that stores a larger quantity of sheets than the sheet feeding tray unit 30. In the case in which a large number of normal sheets are to be output, the sheet feeding apparatus 200 is used in place of the sheet feeding tray unit 30.

The finishing apparatus 300 carries out finishing operations on the sheets on which images have been formed. In concrete terms, the finishing apparatus 300 has a first sheet discharge tray 310, a stacker 320, and a finisher 330.

The first sheet discharge tray 310 is a tray on which the sheets discharged by the image forming apparatus 100 are placed.

The stacker 320 stores the sheets discharged from the image forming apparatus 100. The stacker 320 is used in the case when a large number of sheets for normal images are output.

The finisher 330 carries out the operations of sorting, (hole) punching, stapling, center folding, cutting, etc. The finisher 330 discharges the sheets on which these operations have been made to the second sheet discharge tray 331. The second sheet discharge tray 331 is a tray on which the sheets discharged by the finisher 330 are placed.

The printer controller 500 receives a print job from the user terminal 600 via the LAN (Local Area Network) 601. The print controller 500 analyzes the print job, and transmits the image data to the image forming apparatus 100 via the video bus 501.

The user terminal 600 is a terminal such as a personal computer, etc. The user terminal 600 transmits the print job to the printer controller 500 via the LAN (Local Area Network) 601. The print job is data instructing the printing of the images specified by the user terminal 600, and is written in a Page Description Language (PDL) such as, for example, PostScript (registered trademark of Adobe Corporation), PCL, etc.

(Functions of the Image Forming Apparatus)

Figure 2:
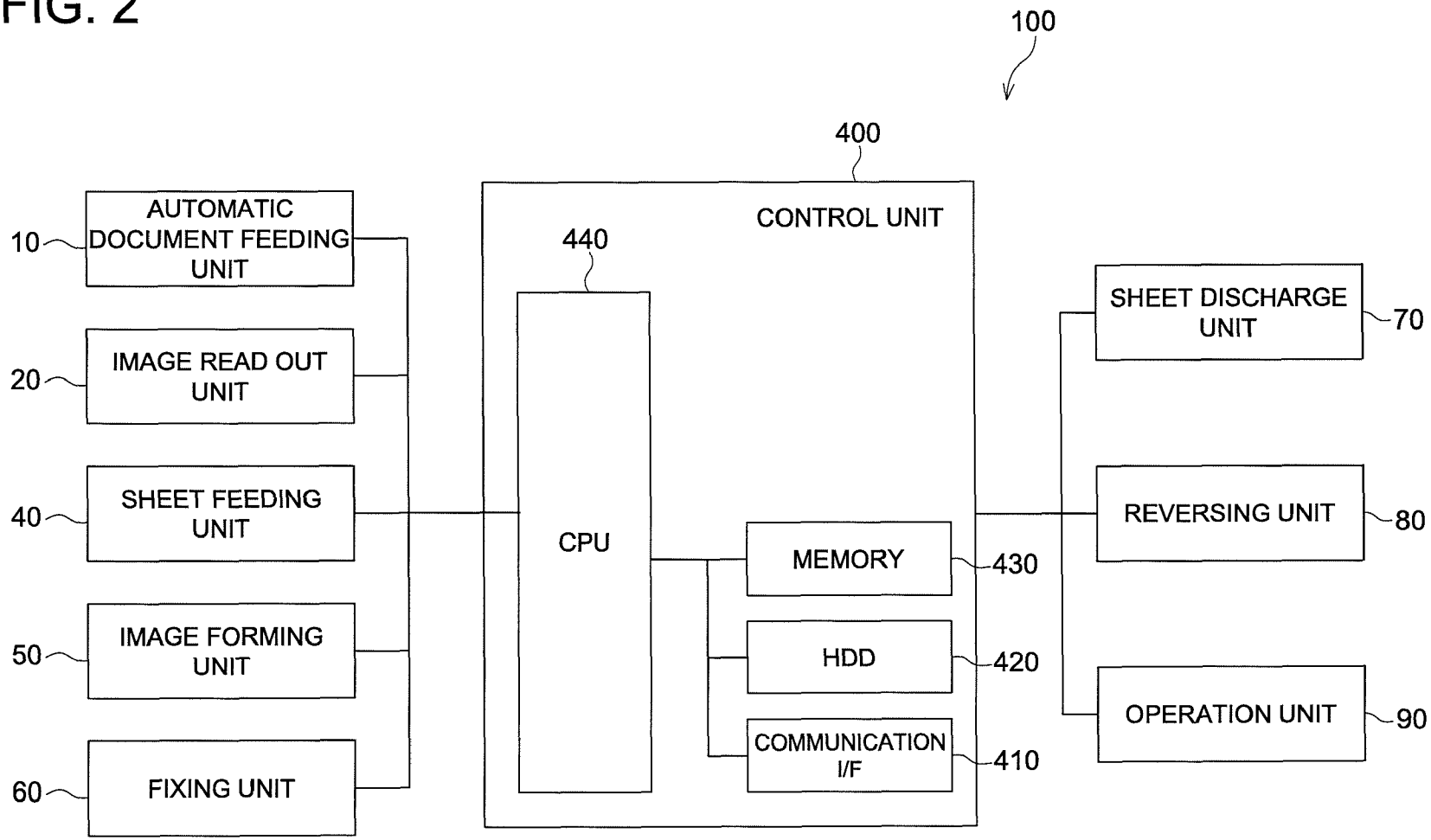
FIG. 2 is a diagram showing the configuration of a control unit 400 according to the first preferred embodiment.

In the following, the functions of the image forming apparatus according to the first preferred embodiment are explained while referring to the drawings. FIG. 2 is a block diagram showing the image forming apparatus 100 according to the first preferred embodiment of the present invention.

As is shown in FIG. 2, the image forming apparatus 100 has a control unit 400 that comprehensively controls the image forming apparatus 100. The control unit 400 has a communication interface (I/F) 410, an HDD 420, a memory 430, and a CPU 440.

The communication I/F 410 is connected to the video bus 501, and obtains image data from the print controller 500.

The HDD 420 stores the control programs and the information related to the functions of the image forming apparatus 100.

The memory 430 is configured using semiconductor memories such as DRAMs, etc. The memory 430 temporarily stores the image data obtained from the image read out unit 20 or the image data obtained from the communication I/F 410. Further, the control programs stored in the HDD 420 are laid-out in the memory 430.

The CPU 440 controls each component of the image forming apparatus 100 according to the control programs laid-out in the memory 430. In the following, explanation is given mainly about the operations of the CPU 440 related to the first preferred embodiment. Therefore, it should be noted that a part of the operations of the CPU 440 have been omitted here.

The CPU 440, based on the normal image data, instructs the formation of normal images to the image forming unit 50. The CPU 440, based on the sample image data, instructs the formation of sample images to the image forming unit 50.

The normal image data is the image data obtained from the image read out unit 20 or the image data obtained from the communication I/F 410. In other words, the normal image data is the image data related to the images (normal images) that are the objects to be copied or printed by the user.

The sample image data is the image data for forming a sample image, and is stored in advance in, for example, the HDD 420, etc. Sample image data is used for verifying whether or not any abnormality has occurred in the output images. Therefore, it is desirable that the sample images are images from which it is easy to grasp changes in the image quality, such as gradation charts, etc.

The CPU 440 instructs the discharging of the normal image sheets or the sample image sheets to the sheet discharge unit 70 or to the finishing apparatus 300. Further, as has been explained above, the normal image sheets are the sheets on which normal images have been formed. Sample image sheets are the sheets on which sample images have been formed.

Here, the CPU 440 controls at least one of the region responsible for the control of image formation (the sheet feeding tray unit 30, the sheet feeding unit 40, the image forming unit 50, the fixing unit 60, etc.,) and the region responsible for the control of the discharge of sheets on which images have been formed (the sheet discharge unit 70 and the finishing apparatus 300, etc.), so that the sheets for normal images and the sheets for sample images can be discharged to appreciate the timings of discharging the sample image sheets. The methods for discharging sheets can be the sheet discharging methods indicated below.

(1) Changing the Orientation of the Sample Image Sheets

Figure 3:
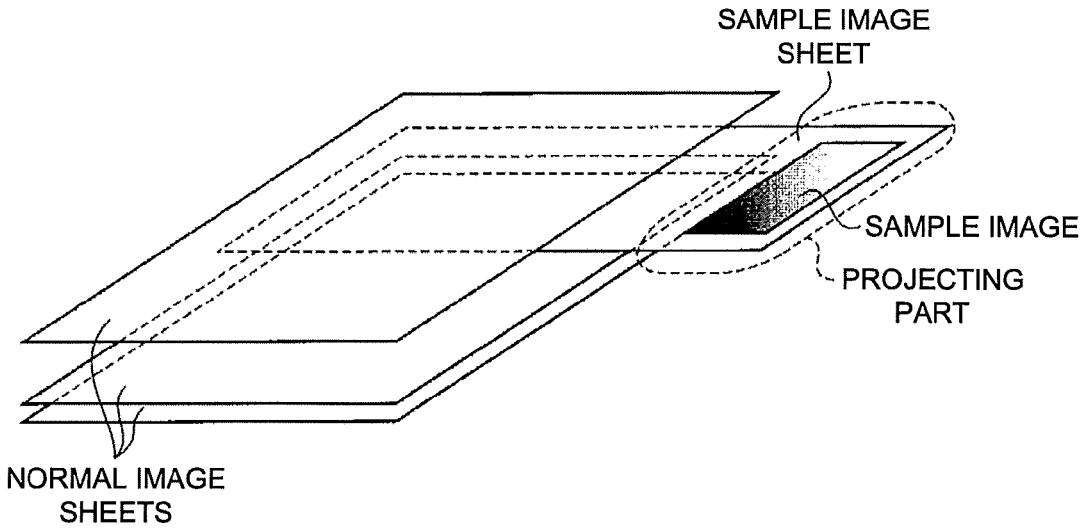
FIG. 3 is a diagram showing the discharging of a sample image sheet according to the first preferred embodiment.

Firstly, an example is given of the case in which the normal image sheets and the sample image sheets are discharged to the same discharge destination. As is shown in FIG. 3, the CPU 440 controls the region responsible for the control of image formation (the sheet feeding tray unit 30, the sheet feeding unit 40, the image forming unit 50, the fixing unit 60, etc.) so that the sample image sheets are discharged with an orientation difference of 90° relative to the normal image sheets. In concrete terms, for example, in the case of forming normal images on a portrait A4 sheet, while the sheets are fed from a sheet feeding tray storing portrait A4 sheets at the times of forming normal images, while the sheets are fed from a sheet feeding tray storing landscape A4 sheets at the times of forming sample images. In this manner, the sample image sheets are discharged so that they would project beyond the stack of the normal image sheets after being discharged. The sample images are formed on the projecting parts.

It is desirable that this method of discharging the sheets is used when the destination of discharging the normal image sheets and the sample image sheets is the first sheet discharge tray 310.

(2) Shifting the Sample Image Sheets

Figure 4:
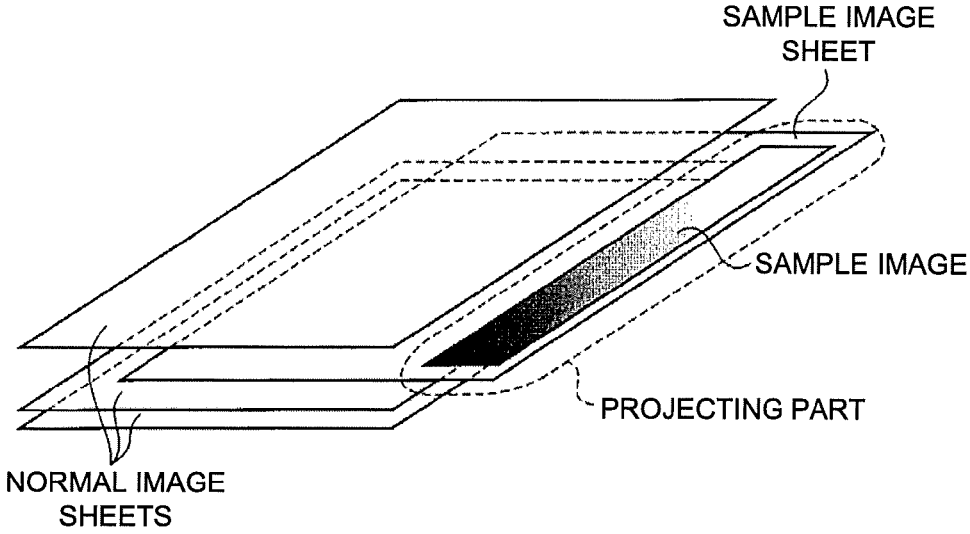
FIG. 4 is a diagram showing the discharging of a sample image sheet according to the first preferred embodiment.

Secondly, an example is given of the case in which the normal image sheets and the sample image sheets are discharged to the same discharge destination. As is shown in FIG. 4, the CPU 440 instructs the method of discharging the sheets to the sheet discharge unit 70 and the finishing apparatus 300 so that the discharged sample image sheets are shifted from the discharged normal image sheets. In this manner, the sample image sheets are discharged so that the sample image sheets have projecting parts that project beyond the stack of the normal image sheets. The sample images are formed on the projecting parts.

It is desirable that this method of discharging the sheets is used when the discharge destination of the normal image sheets and the sample image sheets is the finisher 330.

(3) Discharging of Timing Sheets

Figure 5:
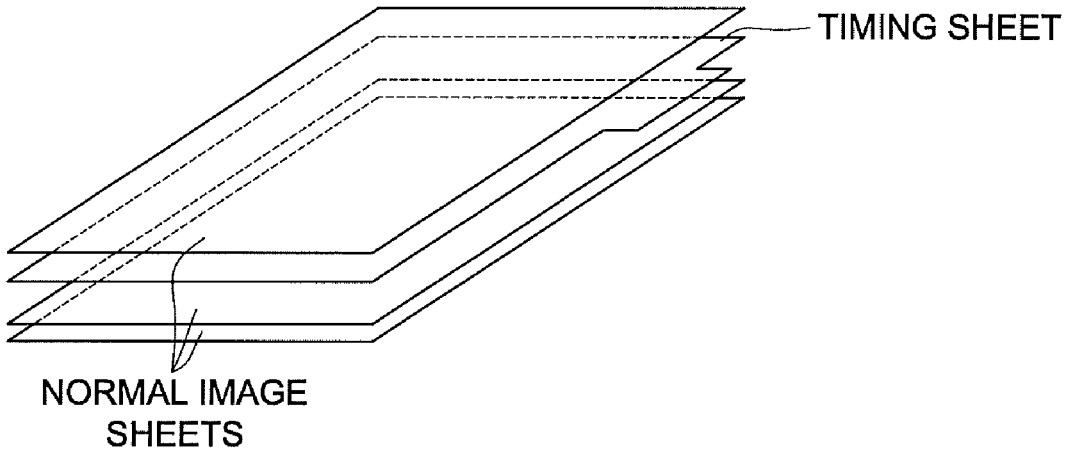
FIG. 5 is a diagram showing the discharging of a sample image sheet according to the first preferred embodiment.
Figure 5:
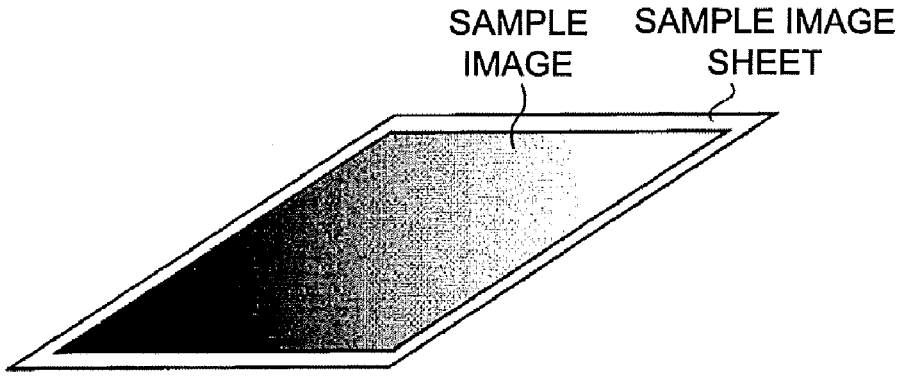

Thirdly, an example is given of the case in which the normal image sheets are discharged to a first discharge destination and the sample image sheets are discharged to a second discharge destination. As is shown in FIG. 5, the CPU 440, in the case in which the sample image sheets are discharged to the second discharge destination, controls the region responsible for the control of image formation (the sheet feeding tray unit 30, the sheet feeding unit 40, the image forming unit 50, the fixing unit 60, etc.) and the region responsible for the control of the discharge of sheets on which images have been formed (the sheet discharge unit 70 and the finishing apparatus 300, etc.), so that a timing sheet indicating that a sample image sheet has been discharged is discharged to the first discharge destination. Further, the time at which the timing sheet is discharged on top of a stack of normal image sheets is synchronized with the time of discharging a sheet of sample images. The sample images are formed on almost the entire surface of the sheets for sample images.

Here, it is desirable that the type of sheets for the timing sheets is different from the type of the sheets for normal images. For example, it is possible to use tab sheets as timing sheets that have projecting parts from the stack of normal image sheets. As to the timing sheets, it is possible to use sheets that have a harder paper quality than sheets for normal images, or sheets with a different base color than the sheets for normal images. In other words, the control is carried out so that, immediately before or immediately after a sheet for sampling images is discharged, a timing sheet is fed from a sheet feeding tray in which sheets for timing are stored, and these sheets are discharged to the first sheet discharge destination without forming any images on the timing sheets.

It is desirable that this method of discharging sheets is used when the discharge destination of normal image sheets and timing sheets, that is, the first discharge destination, is the stacker 320, and the discharge destination of sample image sheets, that is, the second discharge destination, is the first sheet feeding tray 310.

Further, the CPU 440, when the conditions for discharging a sample sheet have been satisfied, instructs the formation of a sample image and the discharge of a sheet of the sample image. The conditions for discharging a sample sheet can be (a) when the number of normal image sheets that have been discharged has reached a prescribed number, (b) when the temperature inside the image forming apparatus 100 has reached a prescribed temperature, (c) when the humidity inside the image forming apparatus 100 has reached a prescribed humidity, (d) when an interrupt operation requesting the discharge of a sheet of sample images has been input from the operation unit 90, etc.

(Operation of the Image Forming Apparatus)

In the following, the operation of the image forming apparatus according to the first preferred embodiment is described with reference to the drawings. FIGS. 6 through 9 are flow charts showing the operation of the image forming apparatus 100 according to the first preferred embodiment, and these flows are started when the power to the image forming apparatus 100 is supplied and the CPU 440 lays out the programs stored in the HDD 420 in the memory 430 and executes them.

Figure 6:
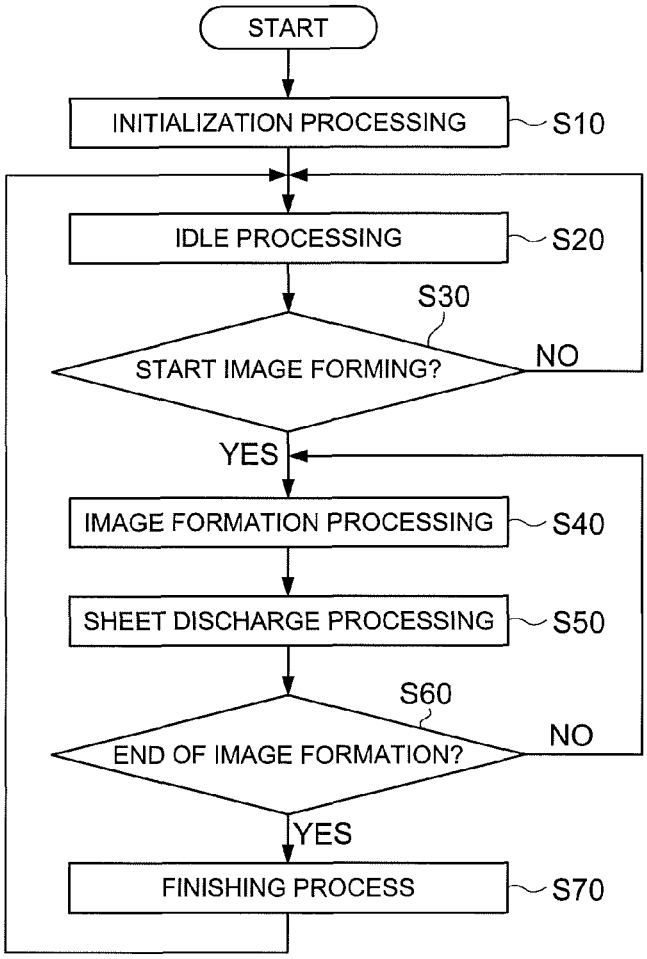
FIG. 6 is a flow chart showing an operation of the image forming apparatus 100 according to the first preferred embodiment.

As is shown in FIG. 6, in Step 10, the control unit 400 initializes the settings, etc., of the image forming apparatus 100.

In Step 20, the control unit 400 transits to the state in which it is waiting for normal image data. The normal image data is the image data obtained from the image read out unit 20 or the image data obtained from the communication I/F 410.

In Step 30, the control unit 400 judges whether or not normal image data has been received. The control unit 400, if normal image data has been received, goes on to the processing of Step 40. If no normal image data has been received, the control unit 400 returns to the processing of Step 20.

In Step 40, the control unit 400 starts the image forming process which is the process of forming images on sheets. The details on the image forming process are described later (see FIG. 7).

In Step 50, the control unit 400 carries out the sheet discharge processing of discharging sheets on which images have been formed. The details on the sheet discharge processing are described later (see FIG. 9).

In Step 60, the control unit 400 judges whether or not the image formations based on normal image data have been completed. The control unit 400, if the image formation has been completed, goes on to the processing of Step 70. If the image formation has not been completed, the control unit 400 returns to the processing of Step 40.

In Step 70, the control unit 400, if finishing is necessary, instructs the finishing apparatus 300 to carry out finishing operations. Finishing operations can be sorting, (hole) punching, stapling, center folding, cutting, etc.

Figure 7:
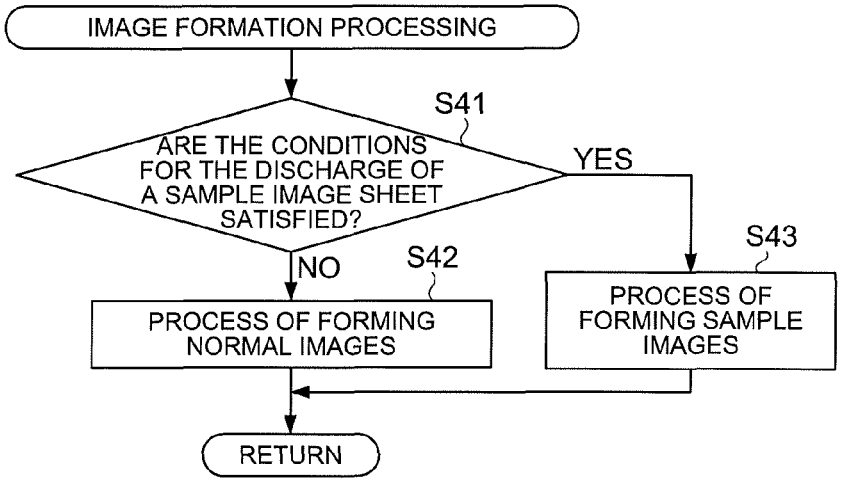
FIG. 7 is a flow chart showing an operation of the image forming apparatus 100 according to the first preferred embodiment.

Next, the details of the image forming process are explained referring to FIG. 7. As is shown in FIG. 7, in Step 41, the control unit 400, judges whether or not the conditions of discharging a sample image sheet have been satisfied. If the conditions for discharging a sample image sheet have not been satisfied, the control unit 400 moves on to the processing of Step 42. If the conditions for discharging a sample image sheet have been satisfied, the control unit moves on to the processing of Step 43.

In Step 42, the control unit 400, based on normal image data, forms a normal image. The control unit 400 outputs the normal image to the image forming unit 50.

In Step 43, the control unit 400, forms a sample image based on sample image data. The control unit 400 outputs the sample image to the image forming unit 50.

Figure 8:
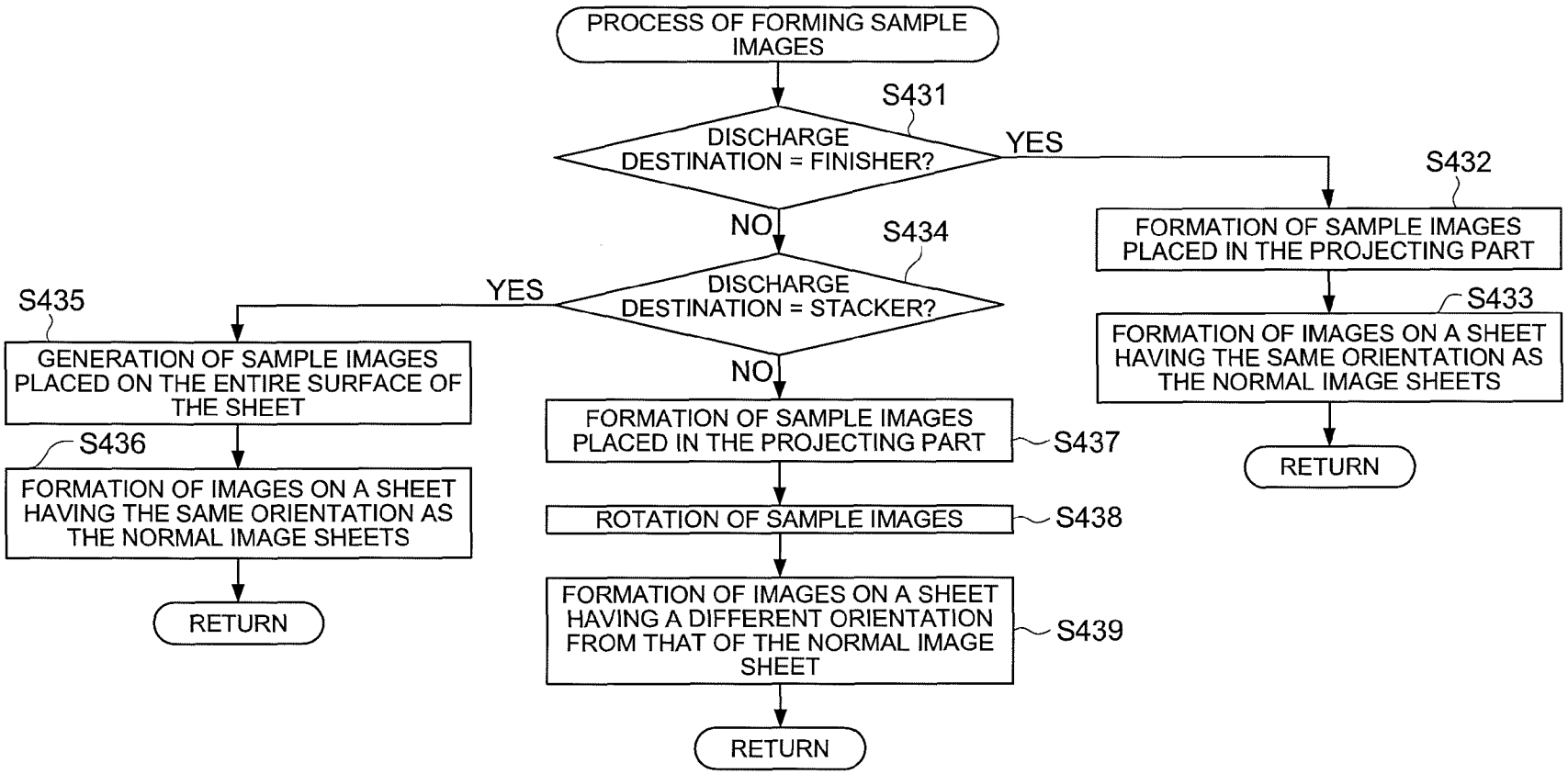
FIG. 8 is a flow chart showing an operation of the image forming apparatus 100 according to the first preferred embodiment.

In concrete terms, as is shown in FIG. 8, in Step 431, the control unit 400 judges whether or not the discharge destination of normal image sheets is the finisher 330. The control unit 400, if the discharge destination is the finisher 330, moves on to the processing of Step 432. If the discharge destination is not the finisher 330, the control unit 400 moves on to the processing of Step 434.

In Step 432, the control unit 400, as is shown in FIG. 4, image data including the sample image is generated so that the sample image can be placed in the projection part that project beyond the stack of normal image sheets when the sample image sheet is shifted relative to the normal image sheets.

In Step 433, the control unit 400 instructs the sheet feeding unit 40 to supply a sheet having the same orientation as the normal image sheets. Subsequently, the control unit 400 instructs the image forming unit 50 to form an image based on the image data so that the sample image is formed in the projecting part. In other words, the control unit 400 outputs to the image forming unit 50 the image data generated in Step 432.

In Step 434, the control unit 400 judges whether or not the discharge destination of sheets for normal images is the stacker 320. The control unit 400, if the discharge destination is the stacker 320, moves on to the processing of Step 435. The control unit 400, if the discharge destination is not the stacker 320, moves on to the processing of Step 437. In other words, the control unit 400, when the discharge destination is the first sheet discharge tray 310, moves on to the processing of Step 437.

In Step 435, the control unit 400, as is shown in FIG. 5, generates image data including the sample data that is placed on the entire surface of the sheet.

In Step 436, the control unit 400, to begin with, instructs the sheet feeding unit 40 to feed a timing sheet. Also, in this step, the control unit 400, instructs the sheet feeding unit 40 to feed a sheet having the same orientation as the normal image sheets. Subsequently, the control unit 400 instructs the image forming unit 50 to carry out image formation based on the image data so that the sample image is formed over the entire surface of the sheet. In other words, the control unit 400 outputs to the image forming unit 50 the image data generated in Step 435, and forms the sample image on the sheet fed following the timing sheet.

In Step 437, the control unit 400, as is shown in FIG. 3, if the sheets for sample images have an orientation that is 900 different from that of the sheets for normal images, generates the image data including the sample image that is formed in the projection part that projects beyond the stack of sheets of normal image.

In Step 438, the control unit 400 rotates the image data generated in Step 437 by 90°.

In Step 439, the control unit 400 instructs the sheet feeding unit 40 to feed a sheet having an orientation that is 90° different from the orientation of the sheets for normal images. Subsequently, the control unit 400 instructs the image forming unit 50 to carry out image formation based on image data so that the sample image is formed on the projection part. In other words, the control unit 400 outputs to the image forming unit 50 the image data rotated in Step 438.

Figure 9:
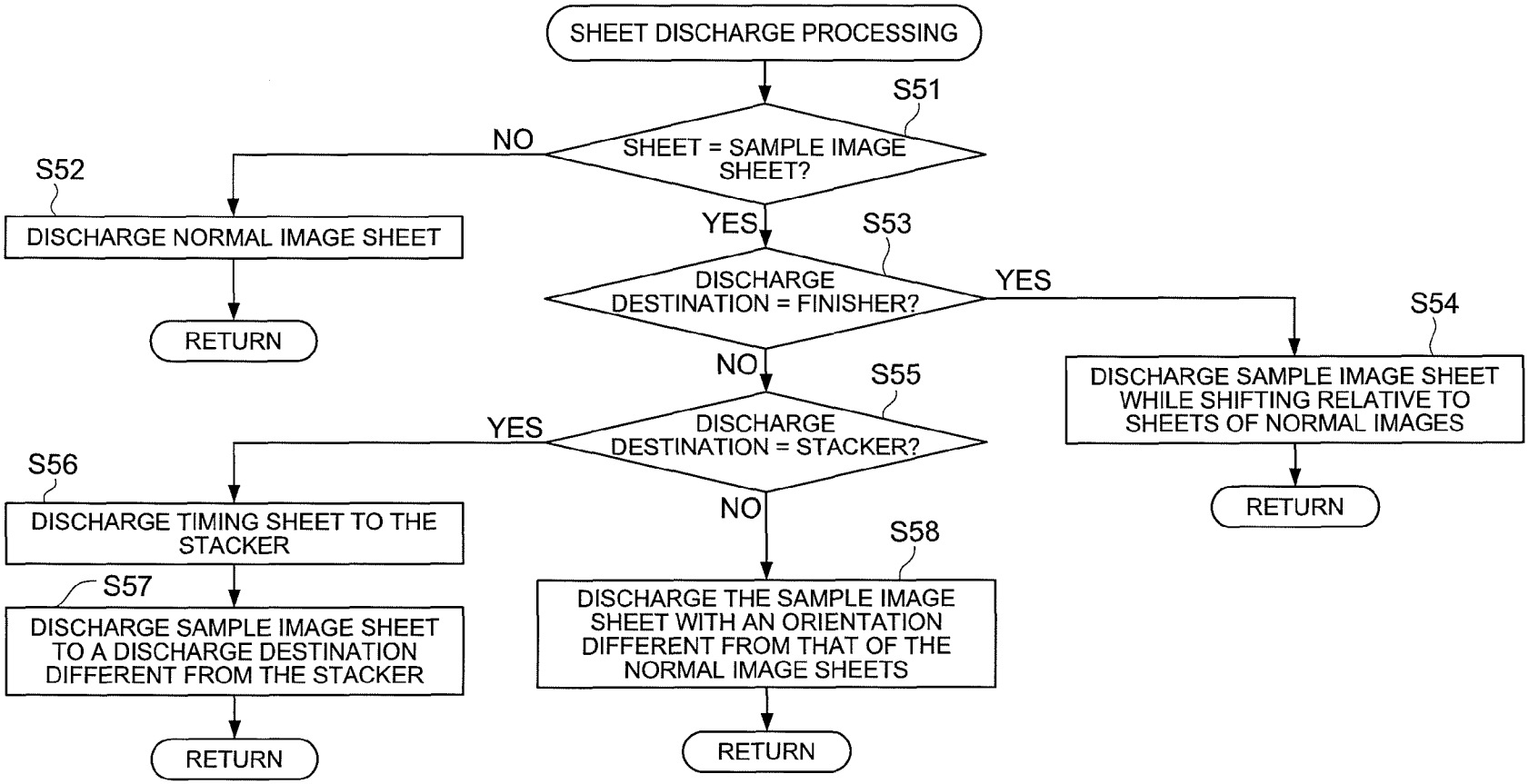
FIG. 9 is a flow chart showing an operation of the image forming apparatus 100 according to the first preferred embodiment.

Next, the details of the sheet discharge processing are explained while referring to FIG. 9. As is shown in FIG. 9, in Step 51, the control unit 400 judges whether or not the sheet on which an image has been formed is a sheet of the sample image. If the sheet on which an image has been formed is not a sheet of the sample image, the control unit 400 moves on to the processing of Step 52. If the sheet on which an image has been formed is a sheet of the sample image, the control unit 400 moves on to the processing of Step 53.

In Step 52, the control unit 400 instructs the sheet discharge unit 70 and the finishing apparatus 300 to carry out sheet discharge of a sheet of the normal image.

In Step 53, the control unit 400 judges whether or not the discharge destination of normal image sheets is the finisher 330. The control unit 400, if the discharge destination is the finisher 330, moves on to the processing of Step 54. The control unit 400 moves on to the processing of Step 55 if the discharge destination is not the finisher 330.

In Step 54, the control unit 400 instructs the sheet discharge unit 70 and the finishing apparatus 300 to carry out sheet discharge of a sheet of the sample image so that the sheet of the sample image is discharged while shifting the sample image sheet relative to the normal image sheets.

In Step 55, the control unit 400 judges whether or not the discharge destination of normal image sheets is the stacker 320. If the discharge destination is the stacker 320, the control unit 400 moves on to the processing of Step 56. If the discharge destination is not the stacker 320, the control unit 400 moves on to the processing of Step 58. In other words, if the discharge destination is the first sheet discharge tray 310, the control unit 400 moves on to the processing of Step 58.

In Step 56, the control unit 400 instructs the sheet discharge unit 70 and the finishing apparatus 300 to discharge a timing sheet to the stacker 320.

In Step 57, the control unit 400 instructs the sheet discharge unit 70 and the finishing apparatus 300 to discharge the sheet of the sample image to a discharge destination other than the stacker 320. For example, the control unit 400 instructs the sheet discharge unit 70 and the finishing apparatus 300 to discharge the sheet of the sample image to the first sheet discharge tray 310.

In Step 58, the control unit 400 instructs the sheet discharge unit 70 and the finishing apparatus 300 to discharge the sheet of the sample image that is conveyed with an orientation different from that of the normal image sheets to the discharge destination to which the normal image sheets are discharged.

(Operations and Effects)

In the first preferred embodiment, the image forming apparatus 100 distinctly discharges normal image sheets and sample image sheets to appreciate in the stack of normal image sheets the discharging timings of the sheets of the sample images were discharged. Therefore, it is possible to easily grasp the timing at which each sheet of the sample image was discharged. Because of this, it is possible to easily grasp the time at which an abnormality occurred in the normal images formed on the normal image sheets.

In concrete terms, the image forming apparatus 100, when the discharge destinations of the normal image sheets and the sample image sheets are the same, discharges sample image sheets with an orientation that is different from the orientation of the normal image sheets. As a result, a part of each sample image sheet projects beyond the stack of normal image sheets, and it is possible to easily grasp the timings at which the sample image sheets were discharged.

The image forming apparatus 100, when the discharge destinations of the normal image sheets and the sample image sheets are the same, discharges the sample image sheets while shifting the sample image sheets relative to the normal image sheets. Therefore, a part of each sample image sheet projects beyond the stack of normal image sheets, and it is possible to easily grasp the timings at which the sample image sheets were discharged.

The image forming apparatus 100 forms the sample image on the projection part on each sample image sheet that projects beyond the stack of normal image sheets. As a result, even in the state in which the normal image sheets are placed over sample image sheets, it is easily possible to visually detect the sample images.

The image forming apparatus 100, when the discharge destinations of the normal image sheets and the sample image sheets are different, discharges timing sheets to the same discharge destination as that of the normal image sheets. Therefore, timing sheets indicating the timings at which sample image sheets were discharged can be inserted in the stack of normal image sheets, and it is possible to easily grasp the timings at which the sample image sheets were discharged by verifying the positions at which the timing sheets are inserted.

Other Preferred Embodiments

Although the present invention was described using the above preferred embodiment, the descriptions and drawings constituting a part of this disclosure shall not be construed to restrict the present invention. Various alternative preferred embodiments, implementation examples, and operation technology will be clear to anyone in this field from this disclosure.

For example, the image forming apparatus 100 is not only an MFP but can be any apparatus that only has a printing function, or can be any apparatus that only has a copying function.

When the discharge destination of normal image sheets is the first sheet discharge tray 310, although the image forming apparatus 100 discharges the sample image sheets with an orientation that is different from the orientation of the normal image sheets, the method of discharging sample image sheets shall not be construed to be limited to this. When the discharge destination of normal image sheets is the first sheet discharge tray 310, the image forming apparatus 100 can also discharge the sample image sheets by shifting the sample image sheets relative to the normal image sheets.

When the discharge destination of normal image sheets is the finisher 330, although the image forming apparatus 100 discharges the sample image sheets while shifting the sample image sheets relative to the normal image sheets, the method of discharging sample image sheets shall not be construed to be limited to this. When the discharge destination of normal image sheets is the finisher 330, the image forming apparatus 100 can also discharge the sample image sheets with an orientation that is different from the orientation of the normal image sheets.

When the sample image sheets are discharged with an orientation that is different from the orientation of the normal image sheets, although sheets with an orientation different from the orientation of the normal image sheets are fed, it is not necessarily restricted to this. It is also possible to feed the sheets with the same orientation as the orientation of the normal image sheets and the sheets are rotated inside the image forming apparatus 100.

When the discharge destination of normal image sheets is the stacker 320, although the image forming apparatus 100 feeds sheets from a sheet feeding tray that feeds timing sheets, the source of feeding of the timing sheets need not be restricted to this. For example, when the finishing apparatus 300 has the collating function and has a sheet feeding tray storing sheets that need to be inserted, it is also possible to feed as timing sheets the sheets stored in the sheet feeding tray of this finishing apparatus 300.

According to a preferred embodiment of the present invention, it is possible to provide an image forming apparatus that makes it possible to easily appreciate the time at which an abnormality occurred in the normal images formed on the sheets for normal images.

What is claimed is:

1. An image forming apparatus comprising:

an image forming section which forms normal images on sheets sequentially based on normal image data and forms sample images on a sheet based on sample image data;

a discharge section which discharges normal image sheets in a stack which are sheets on which the normal images were formed and sample image sheets which are sheets on which the sample images were formed; and a control section which is configured to control at least one of the image forming section and the discharge section to discharge the normal image sheets in the stack and the sample image sheets to the discharge section so as to enable timings at which the sample image sheets were discharged to be appreciated in the stacked normal image sheets, wherein the control section is configured to control the discharge section to discharge the normal image sheets and the sample image sheets to an identical discharge destination so that the sample image sheets protrude from the normal image sheets in the stack at the identical discharge destination, and wherein the control section is configured to control the image forming section to form the sample image at a protruding portion in each of the sample image sheets which protrudes from the stacked normal image sheets.

2. The image forming apparatus described in claim 1, wherein the control section is configured so that the sample image sheets are discharged with an orientation different from an orientation of the normal image sheets.

3. The image forming apparatus described in claim 2, wherein the control section is configured to control the image forming section to form the sample image on a sheet of which orientation is different from an orientation of the sheets on which the normal images are to be formed, thereby discharging the sample image sheets with the orientation different from the orientation of the normal image sheets.

4. The image forming apparatus described in claim 1, wherein the control section is configured to control the discharge section to discharge the normal image sheets and the sample image sheets with shifting relatively each other.

5. An image forming apparatus comprising:

an image forming section which forms normal images on sheets sequentially based on normal image data and forms sample images on a sheet based on sample image data;

a discharge section which discharges normal image sheets in a stack which are sheets on which the normal images were formed and sample image sheets which are sheets on which the sample images were formed; and a control section which is configured to control at least one of the image forming section and the discharge section to discharge the normal image sheets in the stack and the sample image sheets to the discharge section so as to enable timings at which the sample image sheets were discharged to be appreciated in the stacked normal image sheets, wherein the control section is configured to control the discharge section to discharge the normal image sheets to a first discharge destination and the sample image sheets to a second discharge destination and, when each sample image sheet is discharged to the second discharge destination, further to discharge a timing sheet to the first discharge destination which indicates a timing when the sample image sheet was discharged.

6. The image forming apparatus described in claim 5, a type of the timing sheet is different from the normal images sheets.

* * * * *